United States Patent [19]

Stenbacka, deceased et al.

[11] Patent Number: 5,049,755

[45] Date of Patent: Sep. 17, 1991

[54] METHOD AND APPARATUS FOR THE TREATMENT OF SURFACES OF MACHINE COMPONENTS

[76] Inventors: Rolf Stenbacka, deceased, late of Huddinge, Sweden; by Marlene Stenbacka, heir, Vågsättravägen 25, S-141 40 Huddinge, Sweden; Birger Emmoth, Alvagen 9, S-183 63 Täby, Sweden

[21] Appl. No.: 543,810

[22] PCT Filed: Jan. 22, 1988

[86] PCT No.: PCT/SE88/00024

§ 371 Date: Sep. 17, 1990

§ 102(e) Date: Sep. 17, 1990

[87] PCT Pub. No.: WO89/06857

PCT Pub. Date: Jul. 27, 1989

[51] Int. Cl.[5] ..... H01J 3/26

[52] U.S. Cl. ..... 250/492.3; 250/442.1; 250/396 R; 313/361.1

[58] Field of Search ..... 250/492.3, 492.1, 396 R, 250/396 ML, 398; 313/359.1, 361.1, 363.1

[56] References Cited

U.S. PATENT DOCUMENTS

| | | | |
|---|---|---|---|
| 3,687,716 | 8/1972 | Steigerwald | 250/492.3 |
| 4,069,457 | 1/1978 | Martin et al. | 328/235 |
| 4,322,622 | 3/1982 | Trone | 313/361.1 |
| 4,829,550 | 5/1989 | Sanderson | 250/492.3 |

FOREIGN PATENT DOCUMENTS 2901056 10/1979 Fed. Rep. of Germany .

*Primary Examiner*—Jack I. Berman
*Assistant Examiner*—Kiet T. Nguyen
*Attorney, Agent, or Firm*—Limbach, Limbach & Sutton

[57] ABSTRACT

In a method for treatment of surfaces of metals or ceramics of machine components by ion irradiation, ions from an ion source (24) are forced to run in an essentially plane helical path inwardly to an inner region. From there the ions are deflected by betatron oscillations and/or by static magnetic and/or electric fields towards a treatment place (34) which is situated in the center inside said inner area, where the surface to be treated is situated. An apparatus for treatment of such surfaces by ion irradiation comprises two annular coaxially disposed magnets (12,20) which are arranged to produce a magnetic field in a vacuum tank. The inner magnet (20) produces a homogeneous field, transversely to the plane in which ions are intended to substantially move and the outer magnet (12) produces an inhomogeneous field which is decreasing outwardly in the radial direction and is also directed substantially transversely to said plane. Electrodes (16) are provided to produce a radial electric field in the area having said inhomogeneous magnetic field and transversely to this field. At least one ion source (24) is provided to inject ions in a path in said area with inhomogeneous magnetic field, a treatment place being disposed in the tank in the center of the inner magnet ring, towards which place ions in said path can be deflected by betatron oscillations and/or stationary magnetic and/or electric fields.

14 Claims, 5 Drawing Sheets

FIG. 8
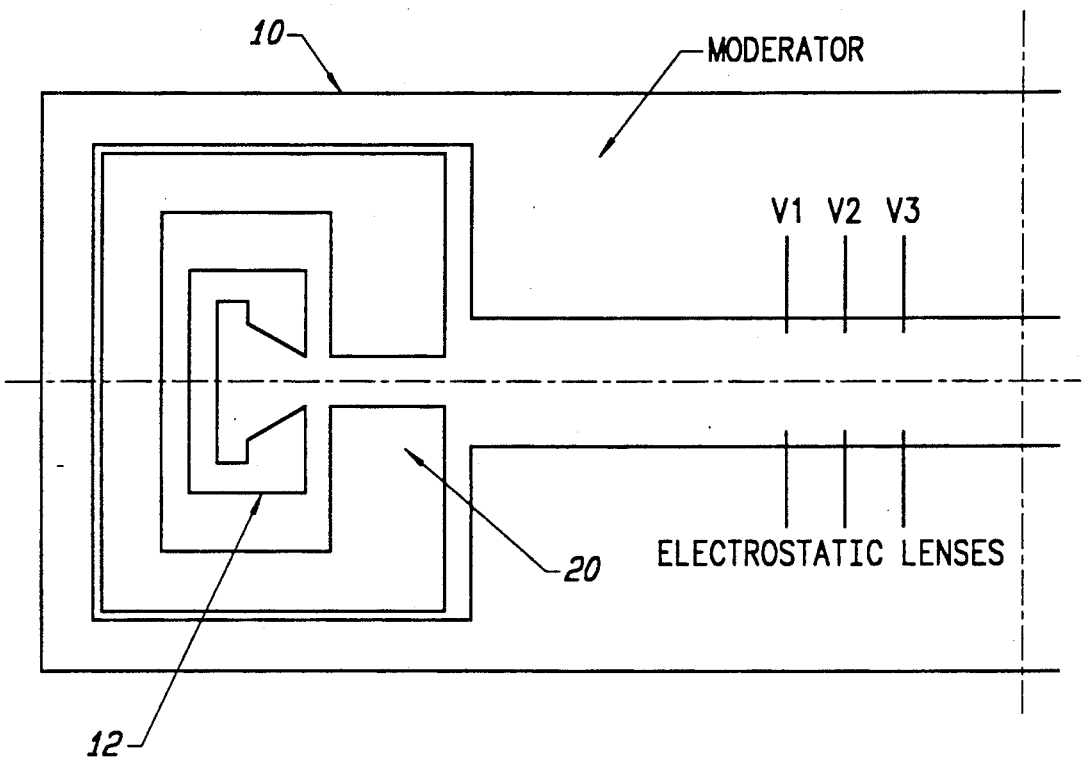
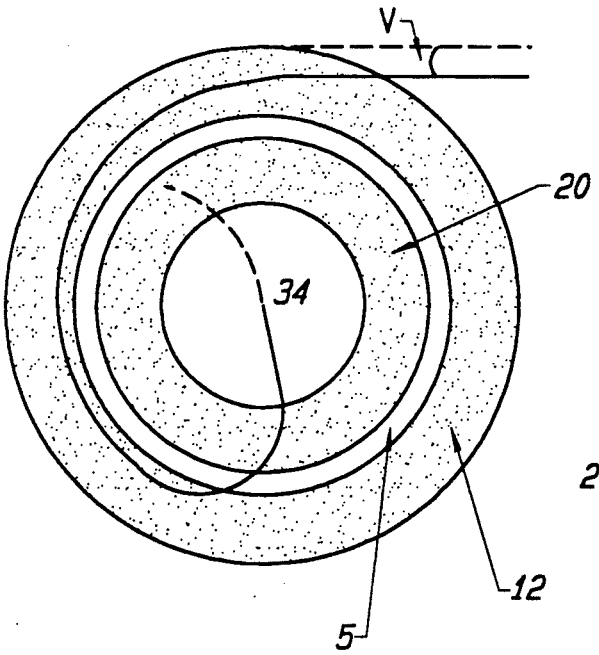
FIG. 9
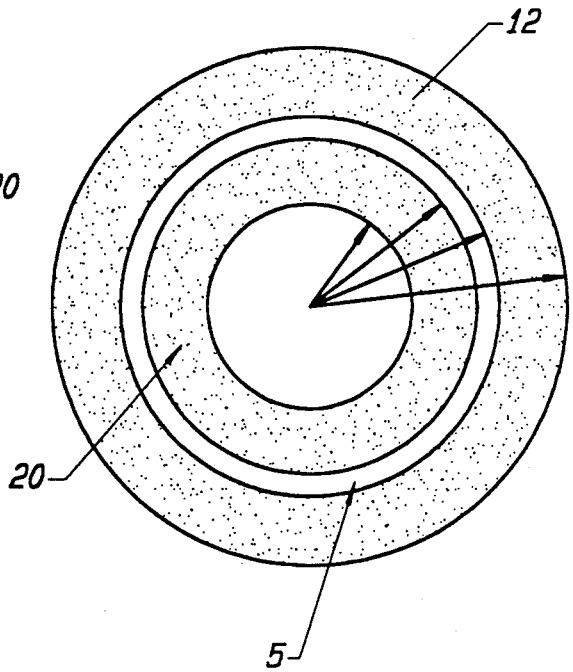
FIG. 7

METHOD AND APPARATUS FOR THE TREATMENT OF SURFACES OF MACHINE COMPONENTS

TECHNICAL FIELD

The present invention relates to a method and an apparatus for the treatment of surfaces of metal or ceramics of machine components by ion irradiation.

BACKGROUND OF THE INVENTION

Properties of metals, such as strength and lubrication properties, can be altered by ion irradiation. Thus e.g. steel can be given a harder surface and altered lubrication properties by implementing heavy ions, such as titanium and molybdenum.

Machine components which warrant advanced surface treatment include steel balls in ball bearings positioned far inside a machine or other machine components, which are so disposed, that mounting and demounting of them for repair or replacement is a difficult and time-consuming operation. By the surface treatment of the subject invention, the life of such machine component can be increased.

The purposes of the present invention is consequently to propose a method and provide an apparatus for such advanced surface treatment.

SUMMARY OF THE INVENTION

According to the present invention, ion irradiation is produced continuously and with a uniform distribution over the irradiated surface.

The present invention simplifies the treatment since no synchronization is needed between the position of the object to be treated and the position of the particle beam. Thus, if, e.g., a wire is to be treated it is brought past a treatment location at a certain velocity which is determined by the intensity of the particle radiation.

Another advantage of the present invention is that the particles can be injected in several points around the peripheri of the apparatus to increase the particle intensity or to simultanously use different particles for the irradiation.

In the apparatus of the present invention, a plurality of magnets can be superposed upon each other, in the uppermost one e.g. argon being injected for cleaning the treated object, in next magnet ring e.g. aluminium being injected for a first treatment, in the following magnet ring e.g. chrome for a second treatment and finally e.g. silicon for colouring and finish. An object of e.g. iron can then be dropped through the four magnet rings for successive cleaning, the first and second treatments and colouring.

By the present invention it is also possible to perform ion irridiation not only by e.g. heavy ions but also by substances, which normally exist in gaseous form. If such substances are applied which do not directly oxidize with the oxygen of the air, e.g. nitrogen, improved corrosion properties are then obtained.

Further advantages are that known components such as ordinary magnetic materials, conventional vacuum pumps, ion sources, accelerators and beam optic equipments can be used in the construction of the apparatus according to the invention.

According to an advantageous further embodiment of the invention a layer of a suitable material is first applied to the surface to be treated, e.g. by evaporation of for instance chrome, and then the layer coating the surface is subjected to ion irradiation. Ion irradiation improves the adhesion between the surface to be treated and the applied layer, and in this way a thicker layer can be produced. To provide such thicker layers by only ion irradiation is not possible because such a treatment would take absurdly long time.

BRIEF DESCRIPTION OF THE FIGURES

An exemplifying embodiment of the apparatus according to the invention will be described in more detail with reference to the attached drawings, on which:

FIG. 7 shows the arrangement of the magnets in a section along the plane of movement of the particles;

FIG. 8 is a schematic cross-sectional view showing the design of one of the halves of an embodiment of the apparatus according to the invention; and FIG. 9 shows simulated particle paths in the magnet configuration of FIG. 7.

DETAILED DESCRIPTION OF THE INVENTION

Figure 1:
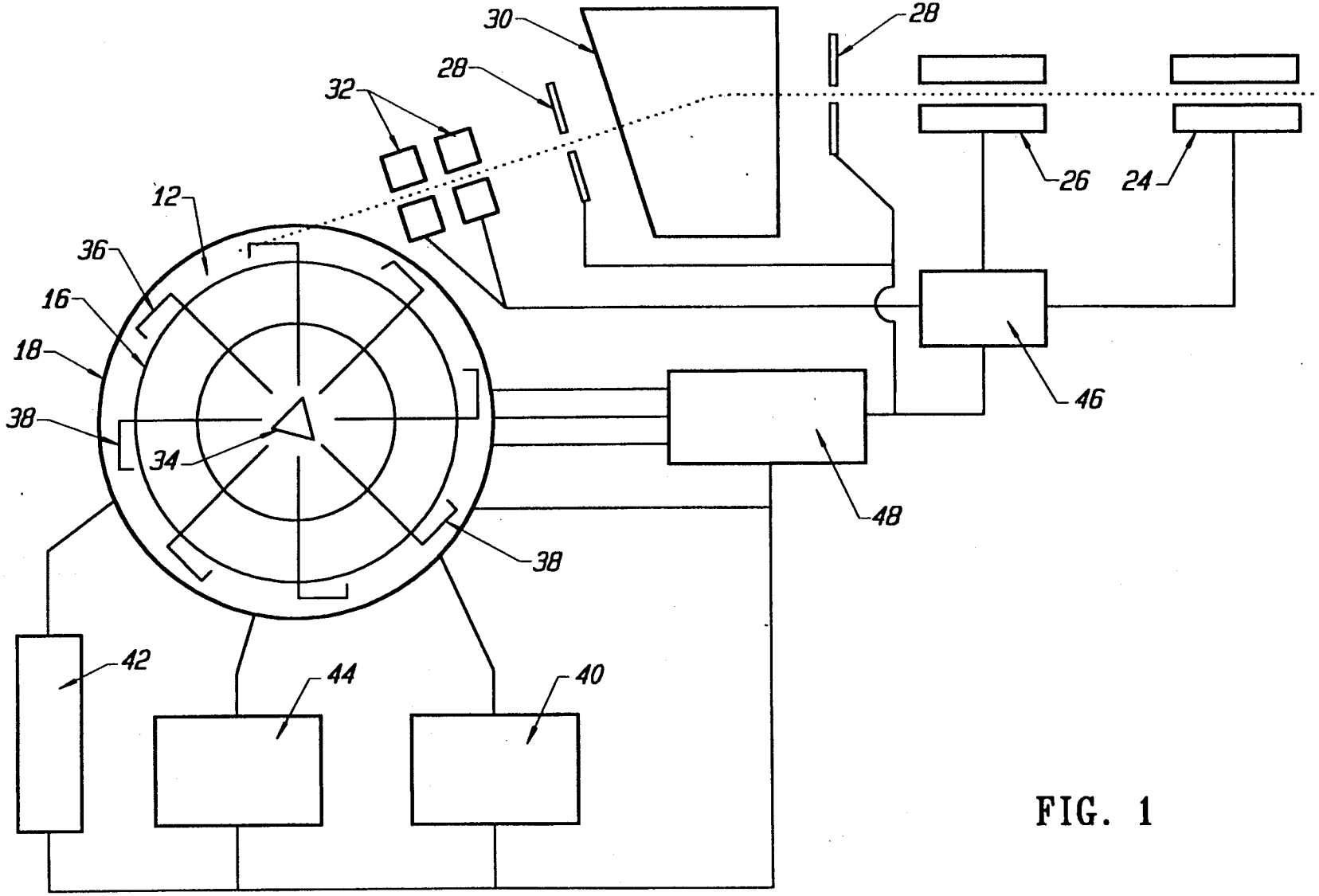
FIG. 1 shows a principal overall view of the apparatus according to the invention.

FIG. 1 is an overall top view of the apparatus according to the invention. An ion source 24 delivers ions which are accelerated in a preferably linear accelerator 26. The beam of the accelerated ions passes beam optical means, e.g., beam forming apertures 28, an impulse magnet 30 and a quadropole lens 32 for focusing and injection into the area in a storage magnet 12.

Two concentric electrodes 16, 18 are disposed to produce a substantially radial electric field inside the storage magnet 12 and essentially transversely to its magnetic field. By interaction between this electric field and the field of storage magnet 12 the ions are moving in an essentially planar inwardly helical path.

When the ions reach the area inside a convergence magnet 20 which is disposed coaxially with the storage magnet 12, they are deflected by the convergence magnet 20 inwardly towards a treatment place 34 in the middle of the apparatus, where the surface to be treated is positioned, cf. also FIG. 9.

In order to stabilize the ion beam while it is being accumulated inside the storage magnet 12, a technique of stochastic cooling is used, in a manner which is described in more detail below. Pick-up and kicker devices 36 and 38, respectively, are therefore disposed along the beam path in the storage magnet at suitable intervals.

Further, the device comprises vacuum pumps 40, not shown in detail, a generator 42 to apply a voltage on the electrodes 16, 18, power supply equipment 44 for the magnets 12, 20, a power source 46 for the remaining equipment, control equipment 48, including a computer. These installations are commercially available and will not be described in detail here.

Figure 2:
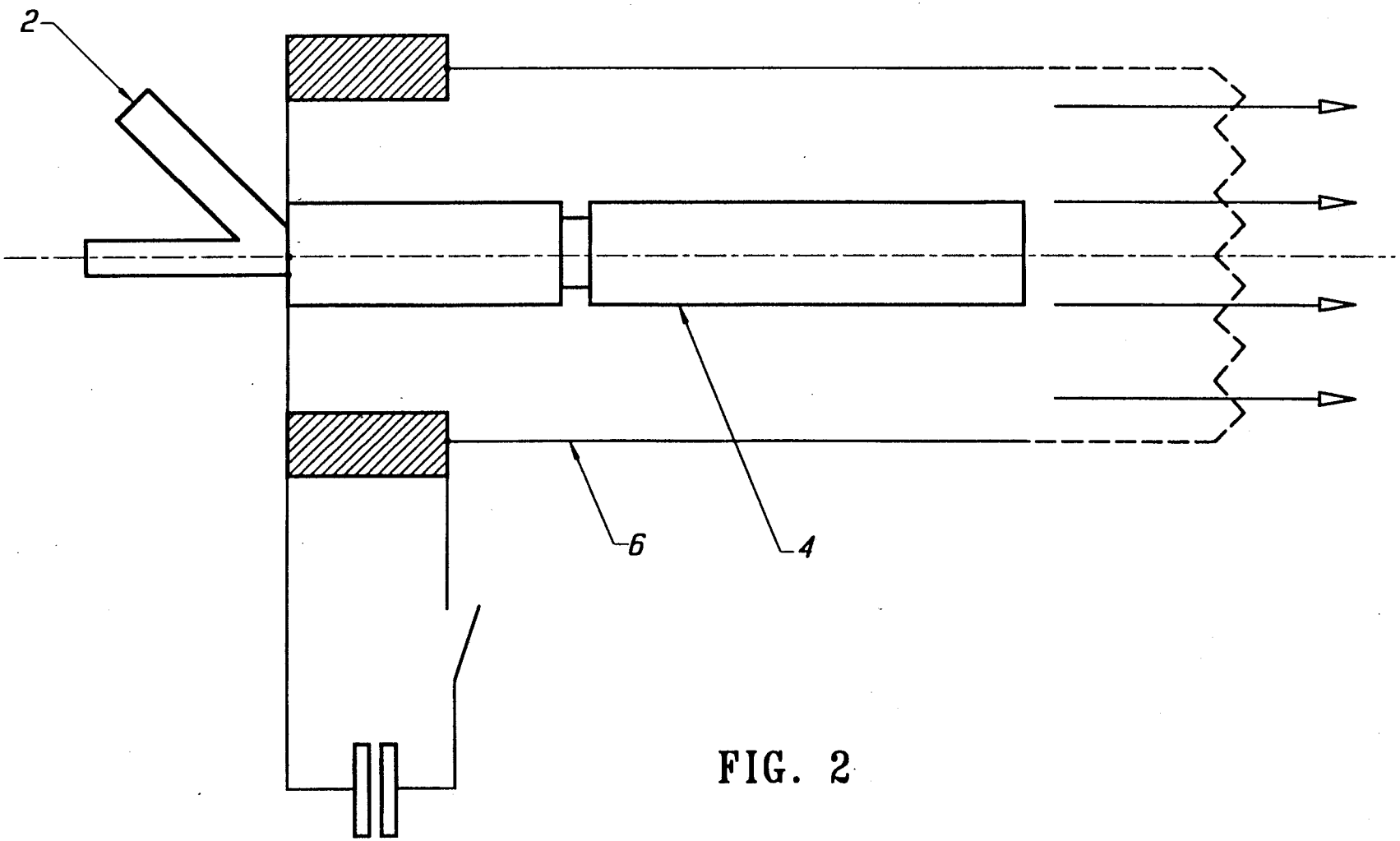
FIG. 2 is a sectional view of a plasma gun which is used as an ion source for injecting ions into the tank of the apparatus.

Ions are produced by a suitable ion source 24, as mentioned above. Such a device is shown in FIG. 2 and comprises a coaxial ion gun. Gas is supplied through the gas supply pipe 2 into the space between two coaxial cylinders 4, 6 which constitute inner and outer conductors. A voltage pulse of 15 kV is applied between the inner conductor 4 and the outer conductor 6, the gas being ionized and the plasma being accelerated by the so-called $j \times B$-force towards the outlet of the gun. j denotes current density and B the magnetic field. In this construction, ion quantities of up to $5 \times 10^{19}$ can be obtained, accelerated to an energy of 2.5 keV. See Rose and Clark Jr., Plasmas and Controlled Fusion, M.I.T. Press 1965, page 418.

As an alternative, ions can be produced in a high-frequency ion source, e.g., atoms being fed into an RF-coil, where they are ionized.

About 40 percent of the introduced energy is transferred to the plasma of the gun.

Several ion sources disposed at different positions around the storage magnet can also be used. According to an advantageous embodiment, ion sources are provided for simultaneous injection of positive and negative ions into the storage magnet. In this way, the treatment surface becomes charge neutral and higher intensities can be produced at the treatment place.

The ions are then accelerated to the energy range of 0.1 to 3 MeV,. For this purpose a linear accelerator 26 of known type is used which includes a voltage multiplier, in which an alternating current is supplied from a transformer under a certain voltage to a rectifying and multiplying device. About 90% of the energy supplied to the accelerator is transferred to the accelerated particles. This type of accelerator is described in e.g., Emilio Segré, Nuclei and Particles 1964, W. A. Benjamin, INC, pages 121–149.

The accelerator is followed by suitable magnetic lenses for focusing the ion beam for injection into the tank of the apparatus. For this suitably quadrupole lenses 32, see FIG. 1, are used as well as the principles of double focusing by a pair of matched magnets in known manner, see e.g. the above mentioned Emilio Segré, Nuclei and Particles 1964, W. A. Benjamin, INC, pages 121–149.

The ions are preferably injected into the storage magnet 12 while forming a certain angle v towards the tangent so that the ions inside the storage magnet will continue along a helical path inwardly towards the convergence magnet 20, see FIG. 9.

To further stabilize the ion beam which has been injected into the reactor tank and avoid instabilities, a principle of stochastic cooling is used, which is described in Physics Reports (Review Section of Physics Letters) 58, No. 2 (1980), pages 73–119. This is a technique for attenuation by feed-back of undesirable movement components in the phase space in a particle beam.

A cooling system to exploit this technique includes a pick-up device 36 which by a broad-band amplifier is connected to a kicker 38.

The pick-up device as well as the kicker can be of transverse as well as of longitudinal type.

Figure 4:
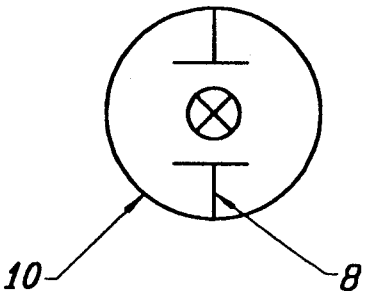
FIG. 4 is an end view of the device in FIG. 3.
Figure 3:
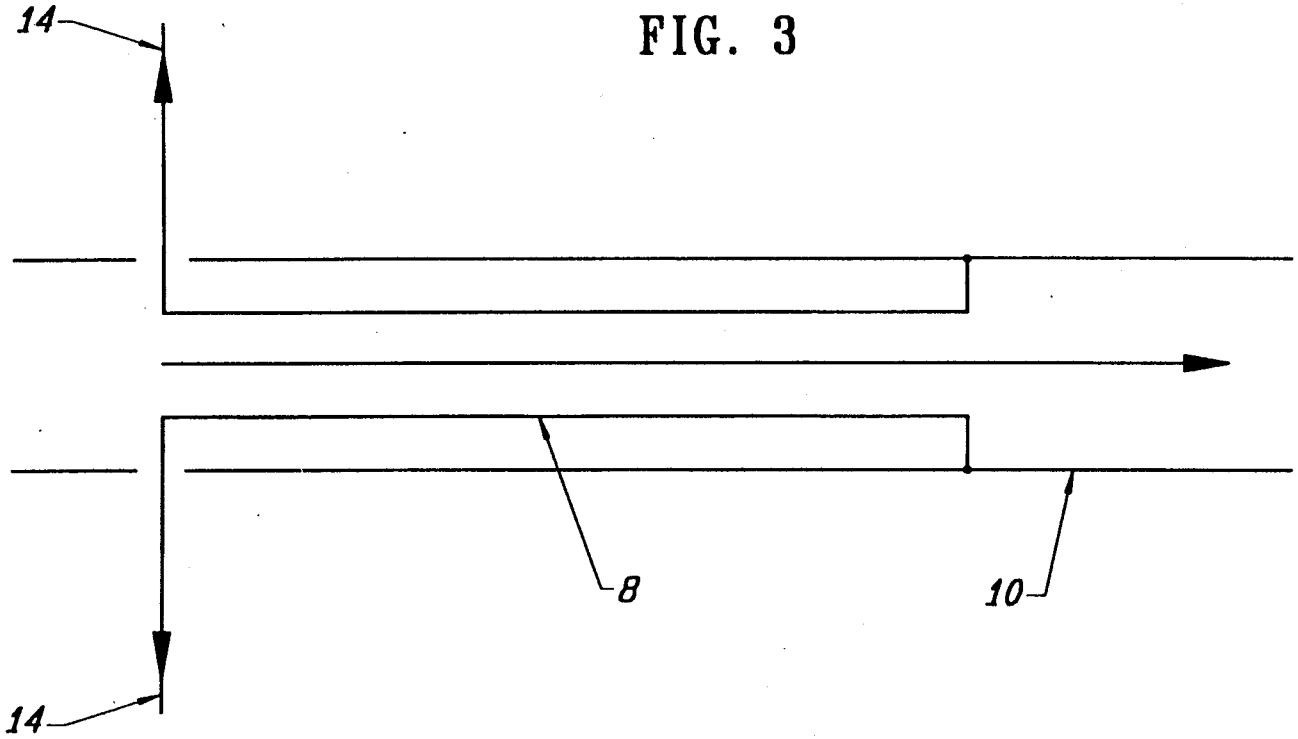
FIG. 3 is a schematic lateral view of a pick-up device.

FIGS. 3 and 4 show a lateral cross-sectional view and an end view, respectively, of a pick-up device which is disposed in the interior of the tank of the apparatus. The pick-up device includes a coupling loop 8 which is connected to tank wall 10. The signal produced in the loop 8 by the ion beam is fed by the conductor 14, as mentioned above, via a broad-band amplifier to the kicker device. By this pick-up device the average position of all particles in the sample of interest is detected and the amplification of the system is adjusted so that the kicker corrects the position of the particles in the desired way.

The kicker device 38 is designed in the same way as the pick-up device 36 and arranged to give velocity correcting impulses to the particles depending on the signal from the pick-up device 36. FIG. 1 shows that a plurality of pick-up and kicker devices can be alternately disposed around the space in the interior of the storage magnet.

Thus, a pick-up device 36 and a kicker loop 38 can be placed at a mutual distance of e.g. $\pi/2$. If the beam deviates in radial direction from a predetermined average value this produces a signal in the pick-up device, depending on the size of the deviation. This signal is amplified and fed into the kicker loop which gives a correcting impulse to the beam.

The kicker devices 38 can also be used to give the particles a larger transverse impulse which can be desirable in certain situations for adjusting the path of the particles, that is the devices can also be used for stochastic heating.

Figure 5:
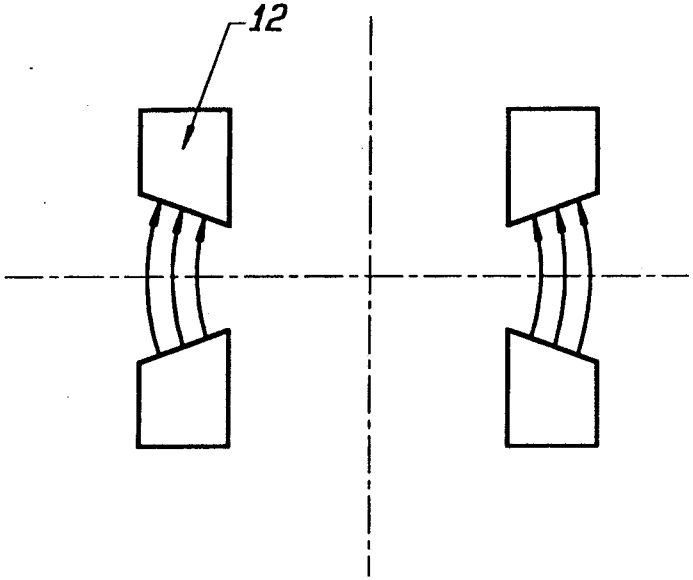
FIG. 5 is a schematic view of the design of the storage magnets.

A magnetic field which varies in radial direction is produced by annular magnets according to FIG. 5. Thus, the magnet ring 12 is designed such that the magnetic field decreases outwardly in radial direction and the magnetic lines of force in the region inside the storage magnet 12 are concave towards the central axis of the tank. In such a field the particles perform so-called betatron oscillations about the median plane i.e. the particle volume has a certain extension perpendicular to this plane.

The magnetic field can also be capable of capturing particles which have not been used and pass through the volume of the treatment location 34 in an inwardly helical path. Recovery of such particles is consequently obtained. In this way higher intensities can be obtained in the treatment place than in the injected particle beam. If the recovered fraction of the injected beam $I_o$ is denoted by F the intensity I in the treatment place is given by $$I = I_o / (I - F)$$

Figure 6:
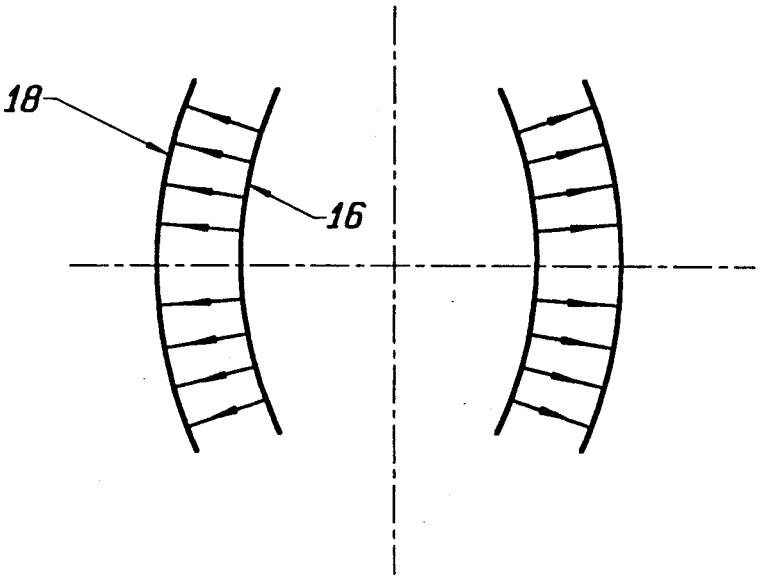
FIG. 6 is a schematic view of the design of the electrodes.

In order to reduce the oscillations and further stabilize the ion beam electric fields are also used. FIG. 6 shows schematically the electrode configuration used to apply a substantially radial electric field in the area inside the storage magnet 12.

FIG. 7 illustrates the construction of magnets. Thus, the apparatus includes mainly two annular magnets 12 and 20, respectively, with an intermediate space 5. The magnet ring 20, the so-called convergence magnet, generates a substantially homogenous field within the inhomogenous field, which is generated by the storage ring 12, as discussed above. Both the fields are stationary.

The convergence magnet generates a stronger magnetic field than the storage magnet. Permanent magnets can be used. The two magnets are constructed individually adjustable.

As magnetic material $Co_5Sm$ (VACOMAX C) is suitably used. The material also exhibits good resistance against mechanical vibrations and can keep the magnetic field constant within a few percent up to a temperature of 250° C. Furthermore, the material has the advantage that it can be easily formed to desired shape.

Thus in the apparatus according to the invention a well focused ion beam with the energy in the range 0.1 to 3 MeV is injected into the collider tank in the area inside the storage magnet 12 with the inhomogenous magnetic field B1 and the electric field E1 crossing each other. These fields are choosen so that the beam follows an inwardly helical path and the fields are advantageously designed to give a focusing effect.

By the inhomogenous magnetic field B1 the particles are influenced by a restoring force perpendicular to the general plane of movement of the particles (z-direction), when deviations from $z=0$ arise. Thus, so-called betatron oscillations arise in the z-direction around an equilibrium position. In a similar way undesirable oscillations in a radial direction may arise caused by the difference between the Lorenz force and the centripetal force. These oscillations can be attenuated by the stochastic cooling described above.

The particle beam in the interior of storage magnet 12 is replenished from the ion source. The particles move along a helical path inwardly till they reach inside the magnet ring 20, the so-called convergence magnet. The magnetic field B2 which is produced by the magnet ring 20, has such a strength that the particles are deflected towards the area in the centre of the apparatus where the ion irradiation take place, cf. FIG. 9.

The deflection inwardly towards the convergence magnet 20 can also be controlled by a small change of the field of the storage magnet 12.

Inside the convergence magnet, magnetic and electric fields are lacking and hence, all particles, which have been injected into the storage ring 12, will move rectilinearly after having left the area inside the convergence magnet 20. Thus, they will reach the tank centre where the machine component is positioned.

Injection of new ions takes place continuously and irradiation of the treatment location similarly takes place continuously from every direction.

FIG. 8 shows a cross-sectional schematic view of one of the halves of the apparatus according to the invention.

An electrostatic lens system, consisting of three electrostatic lenses $V_1$, $V_2$ and $V_3$, focuses/defocuses the ions in the plane. The lenses $V_1$ and $V_3$ have the same potential and consequently, the lens system is symmetrical with the same focusing effect independently of the direction in which the ions pass the lens system. Such a lens system is described in more detail in F. H. Read, Inst. Phys. Conf., Ser. No. 38, 1978, Ch. 6, page 249.

FIG. 9 shows qualitatively the result of simulated particle paths in a configuration of electric and magnetic fields in accordance with the invention. Thus FIG. 9 illustrates as described above, how particles are running in an essentially plane inwardly directed helical path, whereupon the particles are deflected inwardly towards the center of the apparatus (the treatment location), when they reach into the magnetic field B2. In the figure, an example is shown in which the path is deflected inwardly towards the treatment place already on the first turn in the apparatus. Of course, it is also possible that the particles run several turns before they reach the treatment location.

We claim:

1. A method for treatment of metal or ceramic machine component surfaces by ion irradiation, said method comprising the steps of:

a) providing a machine component surface to be treated;

b) providing a treatment location for receiving said component;

c) providing an ion source wherein said ions from said ion source are forced to run in an essentially planar helical path inwardly to an inner region;

d) deflecting said ions by betatron oscillations and/or by static magnetic and/or electric fields towards said treatment location situated in the centre of said inner region.

2. The method of claim 1 wherein said ions are caused to run several turns in said helical path before said deflection step.

3. The method of claims 1 or 2 wherein said deflection step is performed continuously and such that irradiation takes place uniformly and simultaneously over the whole treatment surface.

4. The method of claims 1 or 2 wherein said ions passing through or past the treatment location and which are not used, are captured in the helical path for recovery.

5. The method of claims 1 or 2 wherein said ions are provided continuously from the ion source.

6. The method of claims 1 or 2 wherein said ion irradiation is performed by ions of nitrogen, titanium, chromium, or molybdenum.

7. The method of claims 1 or 2 wherein positive and negative ions are used simultaneously so that the treatment surface remains charge neutral.

8. The method of claims 1, 2, 3, 4, 5, 6 or 7 wherein said treatment surface is first covered by a layer of material, whereupon said surface layer is irradiated.

9. An apparatus for treatment of metal or ceramic surfaces of machine components using ion irradiation comprising:

a) a vacuum tank;

b) at least one ion source to inject ions in a path within said vacuum tank;

c) two annular, coaxially disposed magnets, arranged to produce magnetic fields in said vacuum tank, the inner magnet producing a homogeneous magnetic field substantially transversely to the plane of the path in which ions are intended to move, and the outer magnet producing an inhomogeneous magnetic field of decreasing magnitude in the outward radial direction, said inhomogeneous magnetic field directive substantially transversely to the plane of the path in which ions are intended to move;

d) electrodes disposed about said vacuum tank to produce a radial electric field in the region of said tank in which said inhomogeneous magnetic field exists, said radial electric field lying in a plane transverse to said inhomogeneous magnetic field; and, e) a treatment place being disposed in said vacuum tank, in the center of said inner magnet ring, wherein ions from said ion source traveling along said ion path are deflected by a force selected from the group consisting of betatron oscillations, stationary magnetic fields, electric fields, and their mixtures.

10. An apparatus according to claim 9 further comprising an accelerator disposed in said ion path, said accelerator providing for acceleration of ions to energies in the range of 10 keV to 3 MeV.

11. An apparatus according to claim 10 further comprising a system of quadropole lenses, said system of lenses arranged to focus the accelerated ions for injection into said ion path within said vacuum tank.

12. An apparatus according to claim 9 further comprising pick up devices and kicker devices which are provided alternately in the annular space inside of the outer magnet, each pick-up device and kicker device including a coupling loop, wherein signals generated in said pick up device coupling loops responsive to said ion movement are provided to the corresponding kicker devices to control the motion of the ions according to the pick-up device signals.

13. An apparatus according to claim 9 wherein said outer annular magnet is selected to provide an inhomogeneous magnetic field whose lines of force are concave towards the central axis of said vacuum tank.

14. An apparatus according to claim 9 further comprising a three-electrode electrostatic lens system for focusing ions in their path.

* * * * *